US006526935B2

(12) United States Patent
Shaw

(10) Patent No.: US 6,526,935 B2
(45) Date of Patent: Mar. 4, 2003

(54) CARDIOID CYCLE INTERNAL COMBUSTION ENGINE

(76) Inventor: Ralph Shaw, P.O. Box 386, Lillington, NC (US) 27546-0386

( * ) Notice: Subject to any disclaimer, the term of this patent is extended or adjusted under 35 U.S.C. 154(b) by 38 days.

(21) Appl. No.: 09/877,464

(22) Filed: Jun. 8, 2001

(65) Prior Publication Data

US 2002/0185101 A1 Dec. 12, 2002

(51) Int. Cl.[7] ..... F02B 75/32
(52) U.S. Cl. ..... 123/197.4
(58) Field of Search ..... 123/197.1, 197.4

(56) References Cited

U.S. PATENT DOCUMENTS

| | | | | |
|---|---|---|---|---|
| 367,496 A | | 8/1887 | Atkinson | |
| 460,642 A | | 10/1891 | Kitson | |
| 537,637 A | | 4/1895 | Hanlon | |
| 854,466 A | | 5/1907 | Cole | |
| 1,162,710 A | | 11/1915 | Powell | |
| 1,326,129 A | | 12/1919 | Chadbourne | |
| 1,408,439 A | | 3/1922 | Buckminster | |
| 1,533,009 A | | 9/1925 | Stuke | |
| 1,964,096 A | | 6/1934 | Tucker | |
| 2,088,332 A | | 7/1937 | Marchou | |
| 2,199,625 A | | 5/1940 | Fiala-Fernbrugg | |
| 2,369,747 A | | 2/1945 | Munn | |
| 3,686,972 A | | 8/1972 | McWhorter | |
| 3,861,239 A | | 1/1975 | McWhorter | |
| 3,886,805 A | | 6/1975 | Koderman | |
| 4,044,629 A | | 8/1977 | Clarke | |
| 4,073,196 A | | 2/1978 | Dell | |
| 4,535,730 A | | 8/1985 | Allen | |
| 4,966,043 A | | 10/1990 | Frey | |
| 5,067,456 A | * | 11/1991 | Beachley et al. | 123/197.4 |
| 5,158,047 A | | 10/1992 | Schaal | |
| 5,170,757 A | * | 12/1992 | Gamache | 123/197.4 |
| 5,394,839 A | * | 3/1995 | Haneda | 123/197.4 |
| 5,465,648 A | | 11/1995 | Cy | |
| 5,799,636 A | | 9/1998 | Fish | |
| 5,890,465 A | * | 4/1999 | Williams | 123/197.4 |
| 6,006,619 A | * | 12/1999 | Gindentuller et al. | 123/197.1 |
| 6,223,703 B1 | * | 5/2001 | Galvin | 123/197.4 |

* cited by examiner

*Primary Examiner*—Noah P. Kamen
*Assistant Examiner*—Jason Benton

(57) ABSTRACT

The cardioid cycle engine utilizes a centrally located output shaft which carries an orbiting crankshaft for each cylinder. The journals of the orbiting crankshafts trace a heart shaped pattern, hence the term "cardioid" cycle. The crankshafts are geared to rotate within the revolving output shaft in the same direction and at the same angular velocity as the output shaft. in the preferred embodiments the offsets of the two shafts are adjusted so that they are additive in the second quadrant of output shaft rotation. This configuration produces four strokes, variable in length and duration, in each 360° of output shaft rotation. The expansion stroke can exceed twice the intake stroke in length, and TDC can occur when the output shaft is well past the normal TDC position, allowing tangential force on the shaft when cylinder pressure is highest. Compression ratios can be varied over the full useable range while the engine is operating. When used as an engine, fuel efficiency and torque are increased, and when used as a compressor the peak torque loads are reduced.

15 Claims, 9 Drawing Sheets

CARDIOID CYCLE INTERNAL COMBUSTION ENGINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR APPENDIX

Not Applicable

FIELD OF THE INVENTION

This invention relates to variations in the rotating assemblies which alter the motion of the piston in internal combustion engines and similar machines.

BACKGROUND OF THE INVENTION

Since internal combustion engines were called "explosion engines" in the late 19th century there has been a continual quest to improve upon the purely sinusoidal curve generated by the crankpin, and therefore the piston in the theoretical case of an infinite rod length, of the simple, reliable and relatively inexpensive configuration used almost exclusively from that period through the entire 20th century.

Some of the earliest inventions sought to provide complete scavenging of the cylinder on the exhaust stroke. Otto cycle engines were limited to compression ratios as low as 3:1 by the quality of the gasolines available, and some even burned the gaseous products of incomplete combustion of coal or wood. These dimensions would result in the dilution of the already poor quality of the incoming charge by 33% unthrottled. The proposed solutions frequently involved an eccentric around the crankpin rotated by gearing so as to add to the upstroke every other revolution on the exhaust stroke. The higher compression ratios, higher flow velocities and valve overlap of modem engines have solved this problem to the extent that exhaust gases are now being reintroduced into the cylinder to control emissions.

A problem that was also frequently addressed is that of piston/cylinder wear. The most commonly placed blame was on the side thrust caused by the connecting rod angle relative to the cylinder centerline. To reduce this angle and therefore the side thrust the accepted norm for rod length to stroke ratio was 5:1. The approach to this problem by those not offering unusual alignment of cylinders or multiple pistons and cranks per cylinder often was a hypocycloidal planetary gear drive. This drive can eliminate rod angularity, but when configured to do so restricts the gear ratio and the ratio of crank to eccentric offset to a single value each. Compared to the conventional engine with an equal total stroke, it reduces the moment arm and therefore the directly applied torque. Rotating the angular alignment can vary the point at which the reduced moment arm is at its maximum, but this also reduces the stroke length. Individual event (intake, compression, expansion and exhaust) strokes remain equal. Also, this problem has been overcome by materials and lubrication so that now very successful engines operate with rod length to stroke ratios of less than 1.5:1.

Another limitation that has received copious attention but limited solution is the lack of tangential force on the crank when the cylinder pressure is highest. In the conventional engine cylinder volume is at its minimum and therefore pressure near its highest, depending on ignition and burning characteristics, when the piston, crankpin and axis of crankshaft revolution are in a straight line at top dead center (TDC). Maximum pressure multiplied by zero moment arm still equals zero torque. Many inventions have in their objects addressed the dilemma of highest cylinder pressure at lowest crank moment and vice versa. P-V diagrams and isentropic events involving perfect gases reveal no loss of efficiency from this condition. Correspondingly, from a practical observation of the process at TDC when the piston is trying only to push the crankshaft out of the block rather than rotate it due to zero moment arm, there is, also due to lack of moment arm no increase in volume within the cylinder. Since there is no increase in volume there is no decrease in pressure in this theoretical ideal situation. The same evaluation is extended as the inertia of the rotating mass continues to rotate the crankshaft. The first few degrees of the sinusoidal path increase the moment arm and therefore the volume very little, but this also decreases the pressure very little. Under these ideal conditions, which do not exist in reality, there is no loss of energy or efficiency. Under real world conditions there is pressure transmitted to the contacting surfaces resulting in friction losses. There are heat losses at the elevated temperatures of combustion and since time is directly proportional to angular velocity rather than the variable piston speed, more heat is lost when the piston moves slowly away from TDC.

In an attempt to provide more torque during the beginning of the power stroke some early designs have proposed additional links between piston and crankshaft, often including a pivoting shaft anchored on the housing to keep all the rods in place. This added size, as well as increased the mass which had to reverse direction several times per cycle, making an assembly incapable of operating at speeds greater than the steam engines of their day.

Cardioid cycle embodiments provide positive moment arm at TDC and more rapid drop of the piston not only because of the advanced angle of the mainshaft along the sinusoidal curve at TDC, but because the total offset of the rod journal from the mainshaft axis of rotation is also increasing rapidly.

Another attempt at reducing this limitation has been to offset the crankshaft from the cylinder centerline. One reason that this has not been accepted as standard practice is that it exacerbates the side force on the piston on one stroke at least, and was first proposed during a time when this problem was of more concern. More importantly, TDC still occurs when the piston, crankpin and crank axis are aligned so that there is no moment arm. This alignment does increase the length of the moment arm between the dead center points and the 90 degree location, and also creates unequal upstroke and downstroke lengths and durations.

The more numerous designs, especially in later disclosures, have concentrated on the eccentrics placed around the crankpin inside the rod or sometimes in the piston around the pin. The amount of offset available in this space usually restricts the effective change in piston path to a small percentage of the total stroke and a means must be provided to rotate the eccentric. Larger offsets are possible, but probably would require counterweights and other expensive modifications.

Fuel efficiency has become a primary object of many inventions. From a theoretical approach there are two areas which are known to produce results and which have not been fully developed. These are the full expansion to ambient pressure and temperature the products of combustion and compression to optimum pressure the pre-combustion mixture. In a conventional Otto cycle engine after 160 degrees of expansion the piston has completed over 97% of its stroke and the exhaust valve is opening. At this point there can be 10% to 15% of the maximum pressure remaining and unrecoverable. There have been numerous attempts to extract this energy by more complete expansion methods using auxiliary cylinders and chambers such as compressing the charge in a small cylinder and transferring it into a larger cylinder for expansion. These methods add complexity, lose heat by conduction and sometimes involve more than four strokes for each cycle. Eccentrics and offset crankshafts have been proposed to extend the expansion stroke but the small increases in stroke available with these methods yield little in efficiency. They also usually affect the length of one or all of the other strokes.

Modifications, innovations and new designs affecting compression ratios are certainly some of the most numerous proposed advances in internal combustion engine technology. Conventional engines have a fixed compression ratio which, for performance and efficiency, in the case of spark ignition engines must be as high as practicable for the octane rating of the fuel used, yet low enough to prevent detonation under worst case conditions. There is wide variation between the optimum compression ratios for these two criteria. Obviously a variable compression ratio is desirable. There have been proposals to vary the size, shape and volume of every constraining surface of the combustion chamber, including secondary pistons within the piston, secondary chambers in the cylinder heads and extensible connecting rods. Current conventional engines compensate for their fixed compression ratios by retarding their ignition timing, enriching their mixture or both when pressures become too high and detonation is approached. Delaying the ignition results in lower peak temperatures and pressures, thus producing less work for the fuel used. Enriching the mixture results in more unburned fuel being exhausted, both wasting fuel and increasing pollution. No compensation is available when the compression pressures are too low for best fuel efficiency. A means to rapidly and continually adjust the compression ratio will allow the engine to operate at optimum compression pressures, ignition timing and mixture ratios throughout its duty cycle. Varying the upstroke travel of the piston is a simple, effective and reliable method of varying the compression ratio. Eccentrics can accomplish this function in the same manner as their initially proposed use to scavenge the combustion chamber if a means to vary their orientation about the crankpin is provided, but their other improvements more recently disclosed may not then be available.

Various supercharged designs have been produced in the evolution of the piston engine. They are common in aircraft use, but have not been widely accepted in the field of passenger and light duty gasoline powered vehicles. The disclosed embodiments should form ideal bases for the addition of pressurized induction. Two of the major problems encountered for such use are solved by the features of the described engines. First, in the conventional supercharged engines the fixed compression ratio had to be lowered to prevent detonation at higher manifold pressures. This resulted in lower efficiency during part throttle operation, especially at low engine speed when a variable volume compressor is used. Second, the small turbocharged engines did not develop much torque at low rpm. The object of most of the supercharged vehicles was to increase fuel efficiency by using a small engine and to restore the power when needed by supercharging. The cardioid cycle engine with variable compression ratio can lower the ratio at high manifold pressure and raise it well above conventional normally aspirated ratios at low manifold pressure. The short intake stroke of this engine displaces a small volume, but the long expansion stroke, along with other attributes, makes it a high torque engine. Supercharging can also assist in scavenging.

The present invention offers simple, robust and economical improvements to the above unsolved deficiencies in current internal combustion engines. It provides expansion on the power stoke to more than double that of the intake displacement. In the preferred embodiment it provides at TDC on the compression stroke a moment arm of more than 40% of the maximum available in a conventional engine of equal intake stroke and greatly increased torque throughout the expansion stroke. It provides an extremely wide range of compression ratios while in operation automatically controlled from engine parameter inputs. In addition all four events of the cycle are completed in 360° of output shaft rotation allowing low speed and therefore low friction operation of the rotating assembly.

BRIEF SUMMARY OF THE INVENTION

The cardioid cycle rotating assembly in its preferred embodiments causes the connecting rod journal to plot a path resembling the outline of a heart. The mainshaft carries, in the position normally occupied by the rod journal in a conventional engine, an orbiting crankshaft referred to herein as a journalshaft, geared to rotate in the same direction as, and relative to the mainshaft, at the same angular velocity. When the offsets of the rotating and orbiting axes are different, the path of the journal becomes asymmetric. When one gear is assembled in a different orientation the pattern is rotated. With these two variables the possible number of paths is extremely large.

The original object was to increase the torque output of an internal combustion engine. Gear alignment provides positive moment arm at top center and the additive offsets increase moment arm throughout the expansion stroke to accomplish this goal.

Another object is to increase fuel efficiency. The large volume of the expansion stroke relative to the intake volume allows more work output from the same energy input.

An additional object which became apparent during the investigation of gear alignments is to provide the ability to adjust the compression ratio during operation. Rotation of the normally fixed gear provides a change in the height of the piston. A means to rotate this gear in response to sensor inputs while the engine is running allows such changes in compression ratios. Higher compression ratios yield increased fuel efficiency to augment the additional expansion in satisfying the second object also.

Spark ignition internal combustion engines used in road vehicles must operate over a wide range of conditions. They must therefore be designed with a large safety factor to prevent failure under the most severe conditions. Wide open throttle, sea level pressure, low RPM and high ambient temperature combined require a significantly lower compression ratio, even with mixture and ignition compensation, than that which will yield best efficiency when even one of these variables, especially throttle, is at an average value. With automatic compression adjustment the basic ratio can be designed for higher efficiency and not only lowered to meet severe conditions, but raised enough to provide maximum efficiency pressure under average part throttle operation.

The more preferred embodiments provide a very long expansion stroke, a slightly shorter exhaust stroke, and much shorter intake and compression strokes. All strokes can be of different lengths. The lower position of the TDC of the exhaust stroke has some advantages. The intake valve and porting design need not be restricted by piston clearance. Maximum compression ratios will not be limited by valve overlap on the exhaust stroke and the need for devices to control the formation of harmful oxide emissions may be reduced.

BRIEF DESCRIPTION OF THE VIEWS SEVERAL OF THE DRAWINGS

Each of these figures remains proportional to the original scale which depicted a bore of four units, mainshaft stroke of 2½, journalshaft stroke of 3½ (offsets of 1.25 and 1.75) and a rod length of eight units. In the views of the alternate embodiments, components which differ from but perform the same function as those in the views of the simple embodiment are identified with the same last two digits as in the simple embodiment.

FIG. 8 is identical to FIG. 3 but shown side-by-side for comparison.

DETAILED DESCRIPTION OF THE INVENTION

Figure 1:
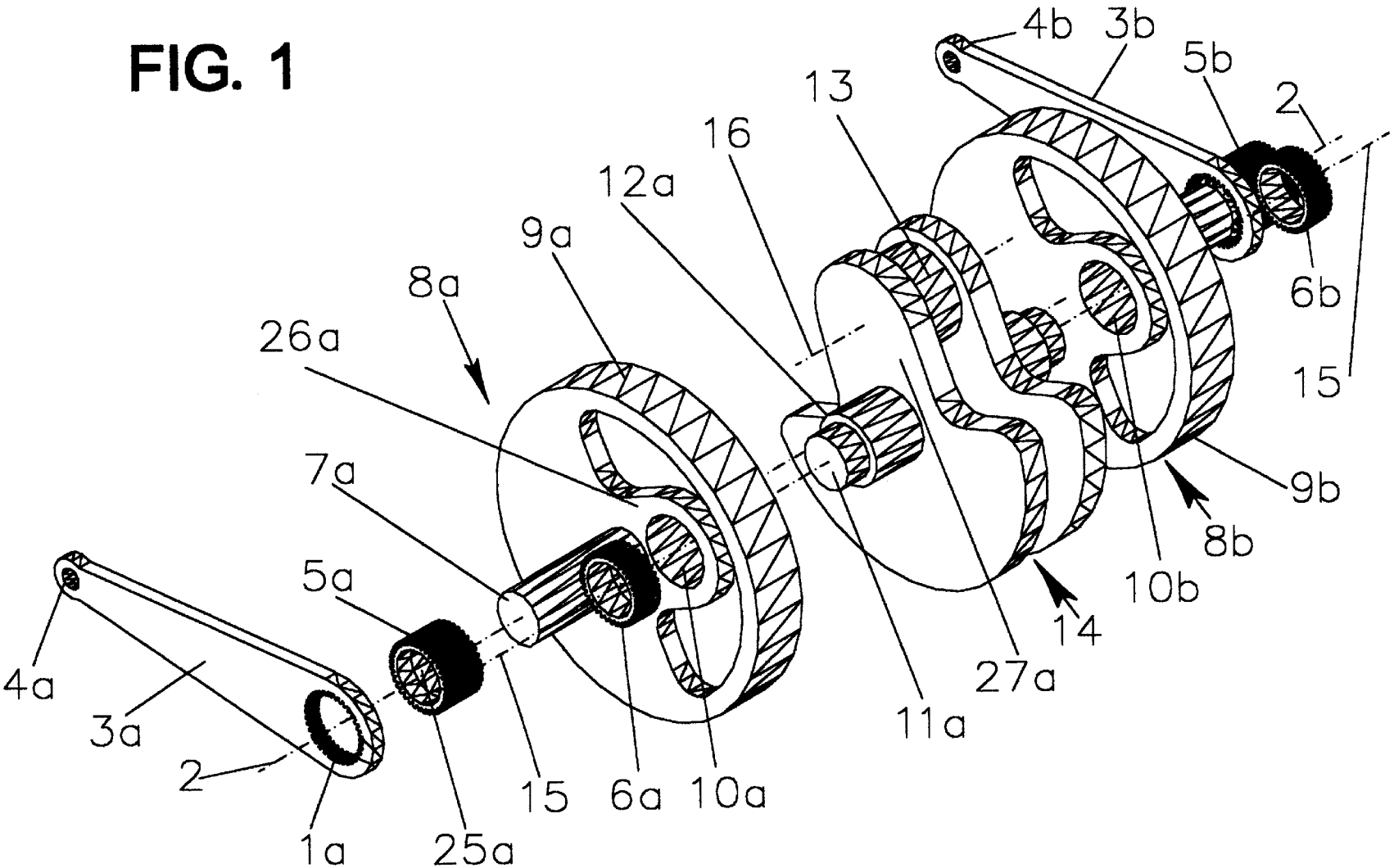
FIG. 1 is an exploded perspective view of a simple embodiment of the rotating assembly of the invention.
Figure 2:
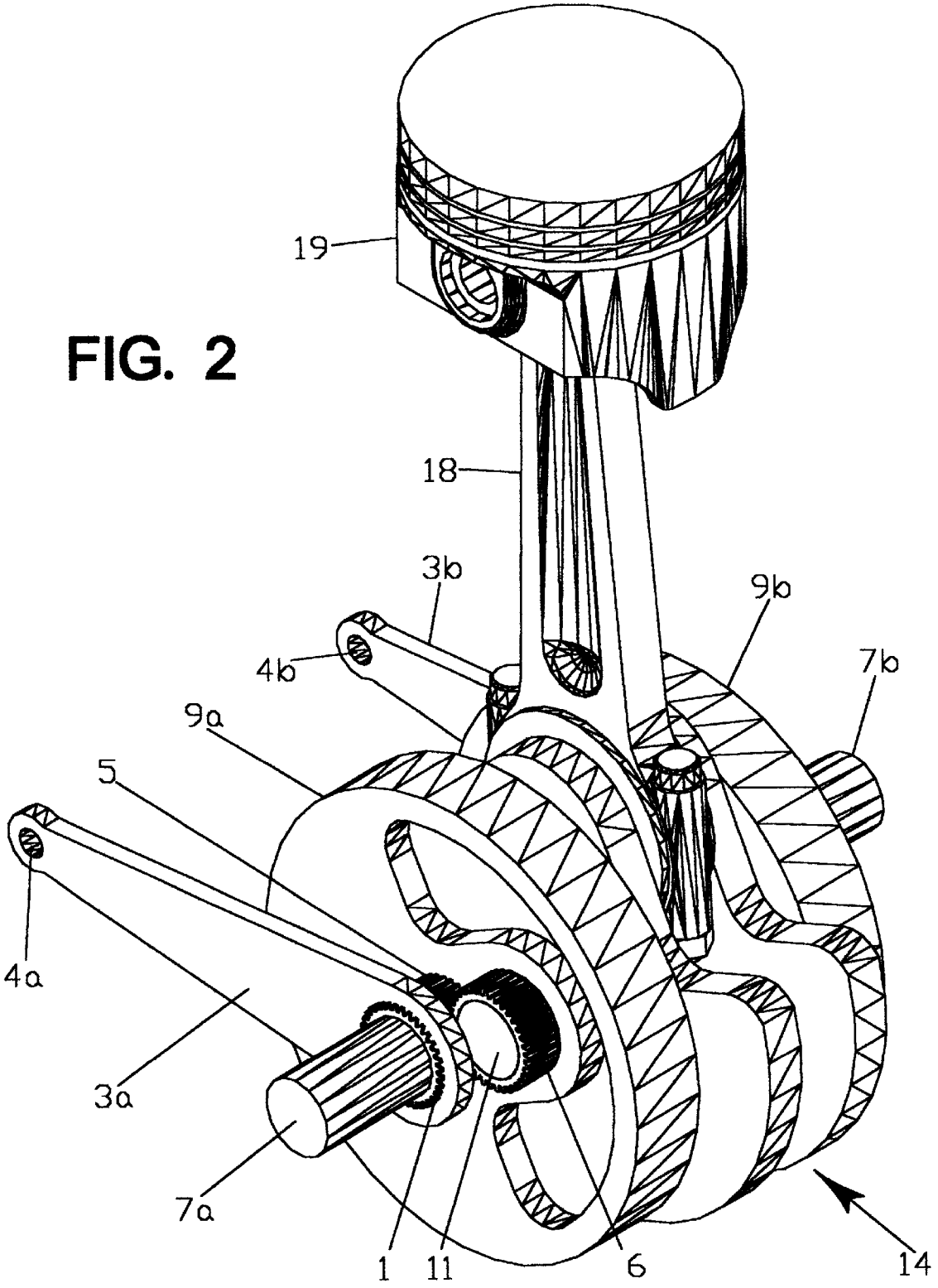
FIG. 2 is a perspective view of the assembled rotating and reciprocating assembly of the simple embodiment.

In a simple embodiment the cardioid cycle rotating assembly comprises a series of input/output shaft segments, a secondary crankshaft, sun gears, planet gears, adjustment levers, a connecting rod assembly, piston assembly and bearings. FIGS. 1 and 2 illustrate these components. The input/output shaft, referred to as the mainshaft for engine applications, comprises the two segments in this single cylinder simple example. Each mainshaft segment 8 is a disc 9 with an integral shaft extension 7 along its rotational axis 2. A bore 10 through the disc web 26 parallel to and offset from this axis establishes the second crankshaft axis of rotation 15 and creates a cavity for a bearing to carry one end of the second crankshaft 14, referred to as the journalshaft since between its two arms 27 it carries a journal 13, the centerline of which is the third parallel axis 16 which establishes the journalshaft stroke. The journalshaft 14, which is effectively a single cylinder crankshaft, can be manufactured as a single piece. Continuity between the mainshaft segments 8 requires the installation of the journalshaft 14, and when installed the mainshaft assembly comprises these members. The sun gear 5 is an external tooth shell (hollow) gear with a bearing surface on the inside diameter. The pitch diameter of the sun gear 5 is equal to the offset of the bore 10. Externally the journalshaft gear 6 is identical to the sun gear 5 in pitch diameter and tooth profile.

Upon assembly, the journalshaft arbors 12 are inserted into the bearings (not shown) in the disc bores 10 and the journalshaft gears 6 are fixed on the protruding ends 11. The sun gears 5 are then placed over the mainshaft extensions 7 and meshed with the journalshaft gears 6. The sun gears 5 are longer than the journalshaft gears 6 by slightly more than the width of the adjustment levers 3 which are internally splinted in their inner ends 1 and pressed onto the teeth of the sun gears 5. The mainshaft segment 8 can rotate freely within the sun gear bore 25 when the sun gear 5 is constrained by the adjustment lever 3 controlled by an adjuster (not shown) attached to its outer end 4. In the single cylinder embodiment a bearing (not shown) is installed on each protruding end of the mainshaft extensions 7 and held by the engine block. Main bearings (not shown), preferably of the anti-friction type, are fitted on the outside diameter of the mainshaft discs 9 and also are held by the engine block. At least one pair of these bearings should resist thrust forces. The connecting rod assembly and piston assembly are similar to those commonly in use in internal combustion (IC) engines today, with the rod somewhat longer than average to accommodate the long stroke.

In this simple embodiment the sun gear 5 is meshed with the journalshaft gear 6 with the mainshaft segments 8 rotated to 0 degrees (disc bore 10 aligned with cylinder axes above the mainshaft rotational axis 2) and the journalshaft trailing by 145°. This geometry and alignment results in the piston reaching top dead center (TDC) on the compression stroke with the mainshaft segment 8 approximately 61° past vertical and a moment arm of approximately 0.4 units. See FIGS. 1, 2 and 3. If the sun gears remain concentric with and fixed about the mainshaft extensions 7, forces on the piston 19 toward the mainshaft rotational axis 2 will be applied through the connecting rod 18 to the rod bearing journal 13. Since the journalshaft 14 is still approximately 22° before vertical these instantaneous forces are relieved by rotating the mainshaft segments 8 which force the journalshaft gears 6 in mesh with the sun gears 5 to travel around the sun gears in the same direction of rotation as the mainshaft segments 8, thereby causing rotation of journalshaft 14. The net vertical movement of the rod bearing journal 13 during this stroke is always downward in a smooth curve. See the chart of FIG. 16.

As the force of the expanding products of combustion pushes the piston 19 downward as described above, the journalshaft 14 rotates about its axis 15 as its axis orbits the mainshaft axis 2 and, since the gearing is 1:1, the journalshaft 14 completes one revolution around its own axis 15 and two revolutions relative to the engine housing (not shown) for each 360° of mainshaft 8 revolution, thus completing four strokes for each revolution of the mainshaft.

The orientation of the two cranks which determine the piston stroke, the mainshaft 8 and the journalshaft 14, is constantly changing since the journalshaft is rotating relative to the mainshaft. The vector sum of components of the radii at a given time determines the moment arm at that instant, and when multiplied by the force applied to the piston, the torque output of the engine. In a conventional engine when the combustion chamber volume is at its minimum (TDC) and the pressure rapidly rising toward its maximum, the moment arm of the crankshaft is zero, and consequently the torque from piston force is zero. In this cardioid cycle embodiment the moment arm at TDC is approximately 40% of the maximum moment arm (offset) of a conventional engine with an equal intake stroke, and remains substantially longer throughout the stroke.

Figures 3, 4, 5, 6:
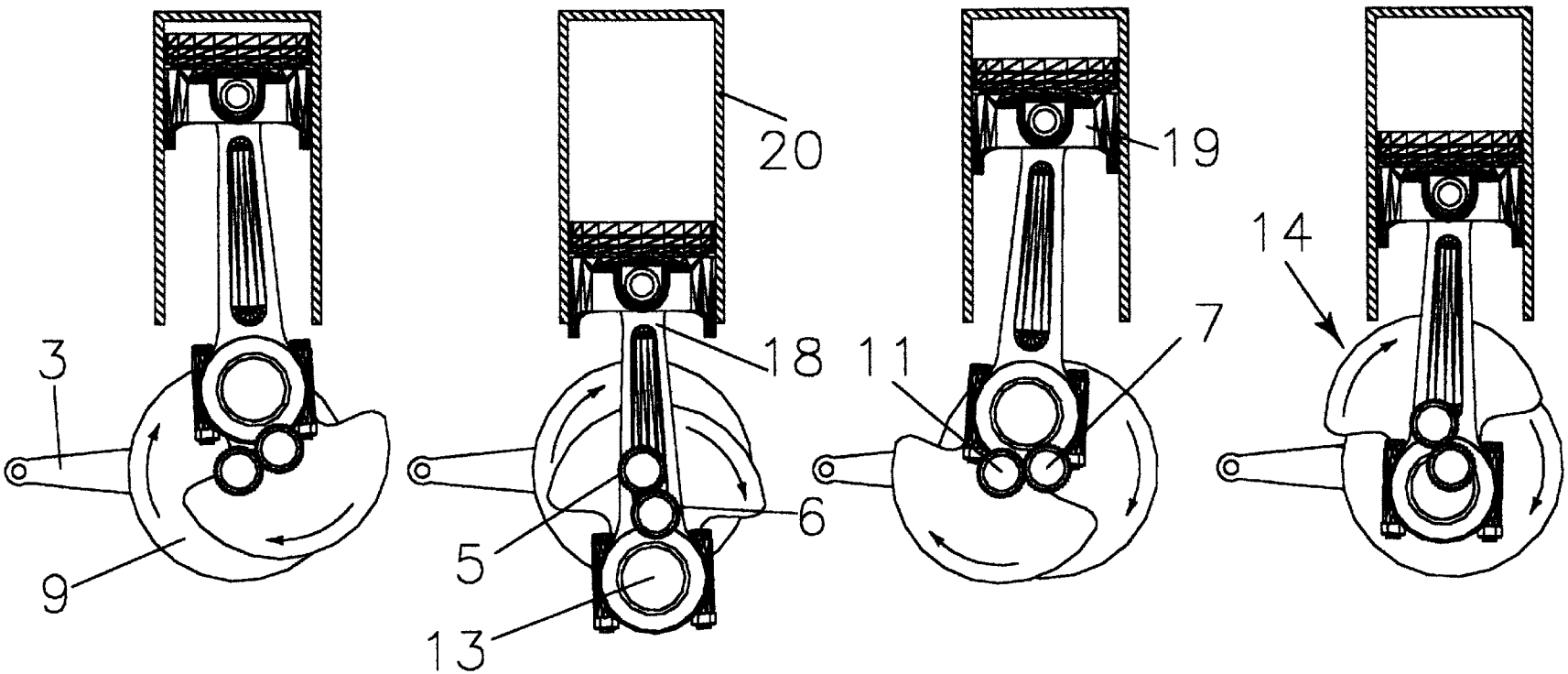
FIGS. 3 through 6 are front elevation views of the dead center positions of the four strokes of the simple embodiment with the front half of several identical pairs of components removed for clarity.

As the expansion stroke continues the journalshaft 14, which was trailing the mainshaft 8 by 145° when the mainshaft was at 0°, but rotating twice as fast, comes into alignment with the mainshaft when the radial from the mainshaft rotational axis 2 to the centerline of the disc bore 10 is 145° past top center. At this point the radial from the journalshaft axis of rotation 15 to the centerline of the journalshaft rod bearing journal 16 becomes a straight line extension of the radial from the mainshaft axis of rotation 2 to the journalshaft axis of rotation 15 and the resultant offset is at the maximum for the cycle, being the sum of the two offsets. From this point the resultant of the offsets begins to decrease and at 164° (FIG. 4), the bottom dead center (BDC) of the expansion stroke, the resultant is approximately 98.5% of the sum of the two offsets. However, the expansion stroke is more than 2½ times the length of the intake stroke and 103° of the 360° cycle. A continuation of the same geometry results in an exhaust stroke of 101° clearing 86% of the volume swept by the expansion stroke (FIG. 5). The intake stroke, shortest of the four in this embodiment, requires only 74° to sweep 40% of the expansion stroke's length. An 82° compression stroke returns the piston 19 to TDC and completes the cycle. FIGS. 3 through 6 depict the end points of the strokes.

Figure 16:
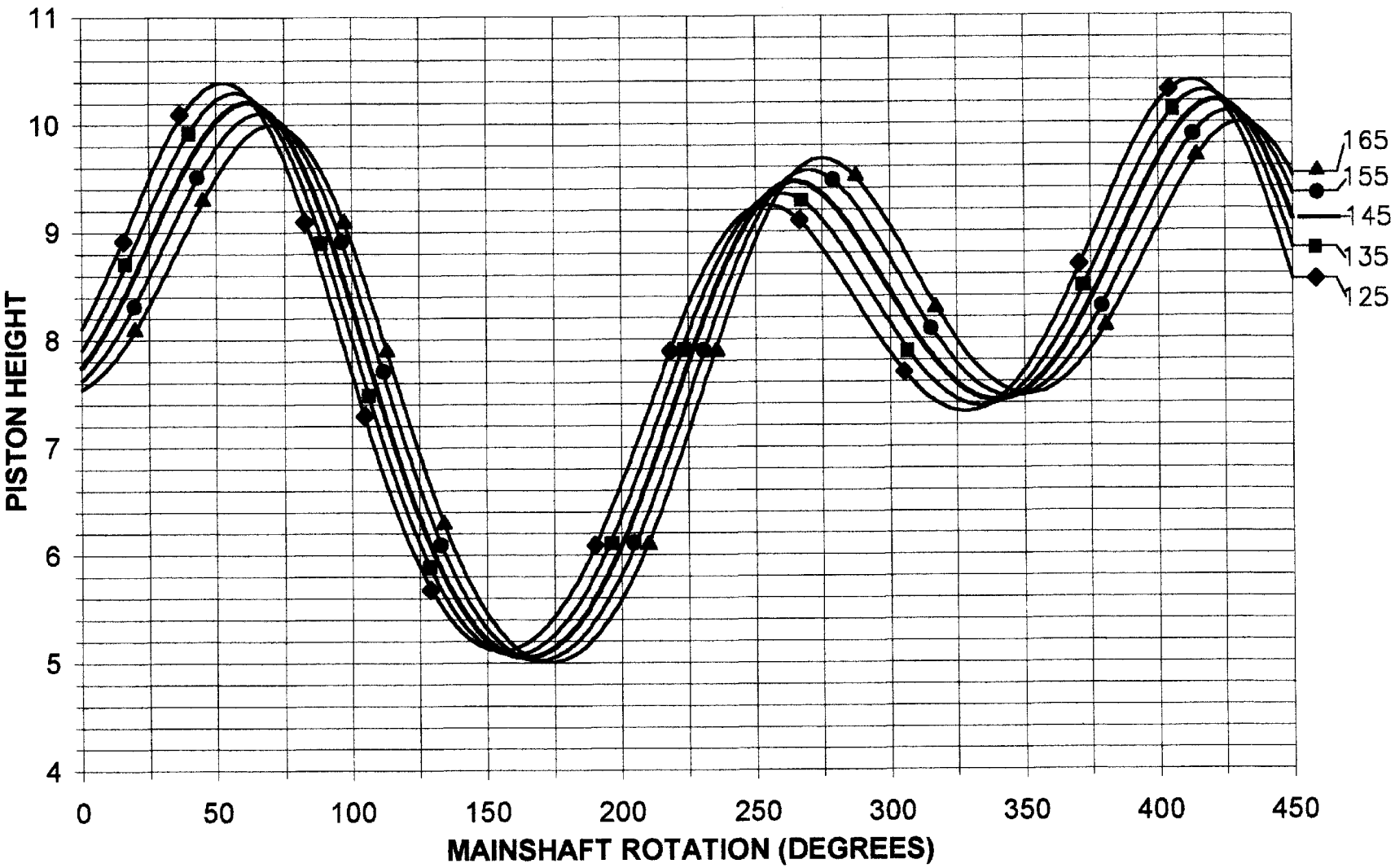
FIG. 16 is a chart showing the effect on the position of the piston in the cylinder of rotating the sun or ring gear in ten degree increments with a fixed stroke ratio.

The foregoing description will reveal to one skilled in the technology the principle and operation of a simple embodiment of this invention, including a positive moment arm at TDC, increased moment arm throughout the expansion stroke and an expansion stroke substantially longer than the intake or exhaust stroke. Although only one combination of gear alignment and stroke ratio is used in describing this embodiment, an almost unlimited number of variations in the cycle dynamics are possible. Using the fixed number three units of length as the sum of the offsets of the cranks as illustrated in these drawings and specifications and examining only ratios of 1:2 to 2:1 by 0.25 unit increments at one gear alignment yields five paths of piston travel, including one in which the piston remains nearly stationary (within 1% of the length of the expansion stroke) for approximately 60° of mainshaft rotation between the exhaust and compression strokes. This path allows a three stroke cycle if used with pressure induction to complete the scavenging and to charge the cylinder. (See curve 2.0 of FIG. 17). Examining stroke ratios above 2:1 reveals an area to be discussed later which could benefit compressors and pumps. FIG. 16 shows five possible paths of one of the stroke (offset) ratios with the drive gear alignment at ten degree increments. With the stroke lengths or sum of the offsets determined by the desired cylinder displacement, the stroke ratios examined in one tenth or smaller increments and the drive gear alignment available in one degree increments it is easy to understand the versatility of this design.

Figure 17:
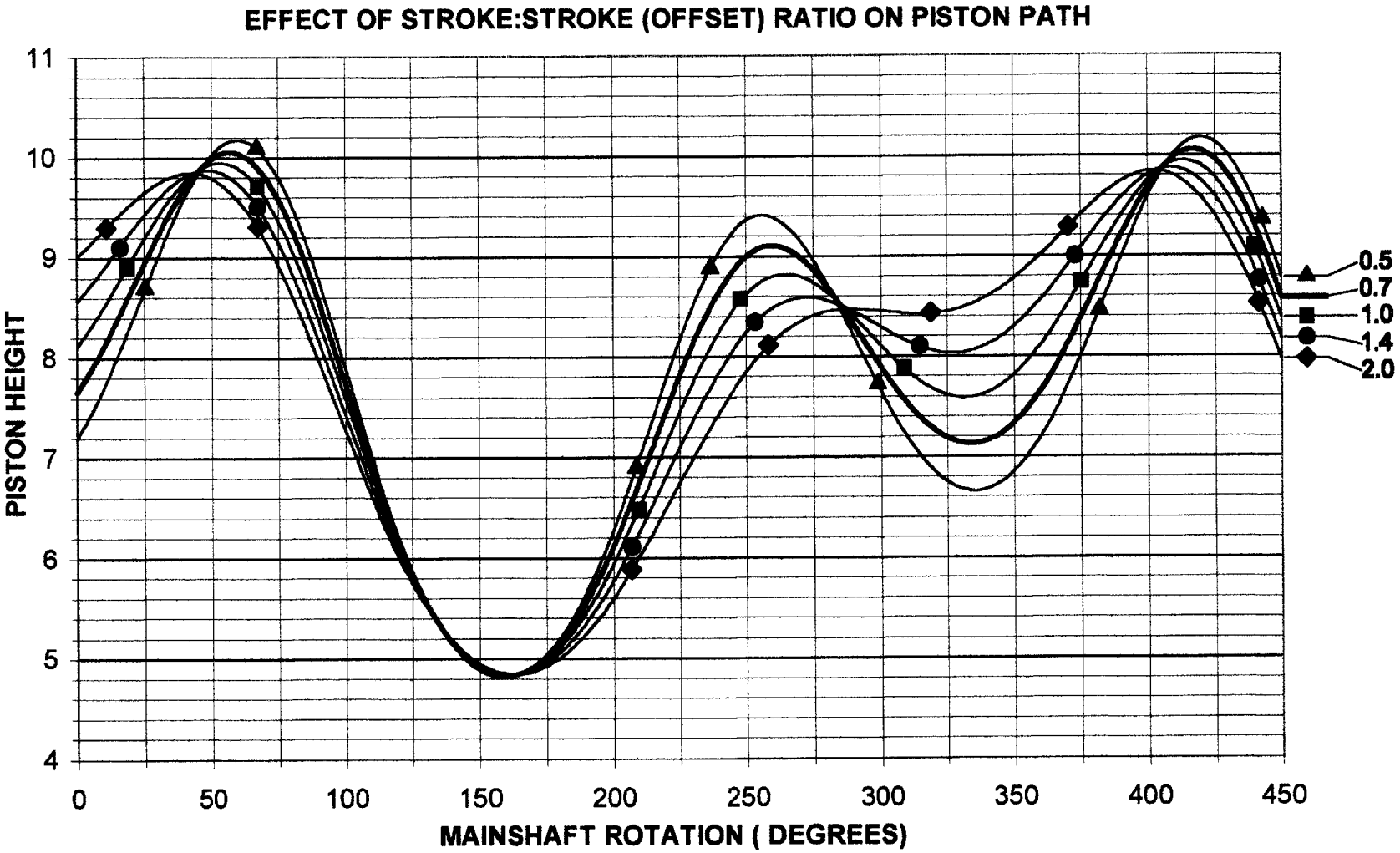
FIG. 17 is a chart showing the effect on the position of the piston in the cylinder of different stroke ratios compared with a single trailing angle set by the sun or ring gear.

The chart in FIG. 17 illustrates the effect on the piston path of selected ratios of mainshaft to journalshaft offsets at a constant trailing angle of 135°. The height of the piston above the mainshaft axis of rotation 2 is plotted as the height of the centerline of the piston pin. The curves are identified with markers and labeled with the ratio. The sum of the offsets for each ratio used to calculate the data for these curves equals three units, or stated differently, the sum of the strokes equals six units. The heavy curve without markers and labeled 0.7 is calculated with a mainshaft offset of 1.25 units and a journalshaft offset of 1.75 units and is the ratio used in all embodiments and drawings explained in these specifications. These dimensions are used to calculate the data presented on the chart of FIG. 16 and all drawings depict this stroke ratio (0.7 mainshaft to journalshaft) and a rod length of eight units. Linear dimensions stated in units can be interpreted on any scale in either English or metric systems.

The ratio has a minor effect on the length of the expansion stroke, a moderate effect on the exhaust and compression strokes and a substantial effect on the intake stroke. The duration of the strokes, especially the exhaust and intake, are affected by the stroke ratio. This is more pronounced at the high end of the range plotted with the exhaust duration increasing by approximately 30° and the intake stroke almost disappearing.

During design, manufacture or assembly all of the variations disclosed above are available by selection of the dimension or alignment required. This simple embodiment presenting only a single path does not require that the sun gear 5 be rotatably mounted. The sun gear can be fixed to the housing (not shown) and the adjustment lever 3 eliminated.

A second embodiment including the adjustment lever 3 constraining the rotatably mounted sun gear 5 allows a modification of the alignment or timing between the sun 5 and journalshaft 6 gears. Any means suitable for exerting and maintaining a force on the adjustment lever outer end 4 can be used to rotate the lever 3 causing the sun gear 5 to rotate through a like angle. This rotation in turn causes the journalshaft gear 6 and the journalshaft 14 to rotate through an equal angle in the opposite direction. By definition the trailing angle will be altered a like amount. FIG. 16 shows the change in path for selected trailing angles. The angles at which the dead center points occur will be altered for all strokes, though not necessarily by the exact angle of rotation of the gears due to rod angle and other geometry. Therefore any significant change should be compensated for by a change in the timing of valves and of ignition or injection.

Each curve on the chart in FIG. 16 shows the different path of a piston caused by a ten degree change in the alignment between mainshaft and journalshaft. The curves are identified by markers and labeled from 125 to 165 indicating the trailing angle of their alignment. All other variables are held constant. The different paths can be selected by gear alignment upon assembly or rotation of the center mounted gear. In the simple embodiment the sun gear is center mounted. By adjusting this gear any of the plotted paths or any intermediate path can be chosen and varied during operation. The height of the piston above the mainshaft axis of rotation is plotted in the same manner as in FIG. 17. A change in the trailing angle has a significant effect in the piston height achieved at TDC which allows the adjustment of compression ratio. The zero degree reference for the mainshaft is the orientation aligning the journalshaft axis of rotation 15 directly above the mainshaft axis of rotation 2, or aligning both axes and the cylinder centerline in the same plane. This is the same as TDC for a conventional engine and the same as described earlier in the procedure for meshing the gears. The trailing angle is defined as the angle by which the journalshaft 14 rotation trails the mainshaft 8 when the mainshaft passes through zero degrees. This is also equal to the angle past zero degrees where the offsets of both shafts are aligned to produce the maximum total offset.

Figure 12:
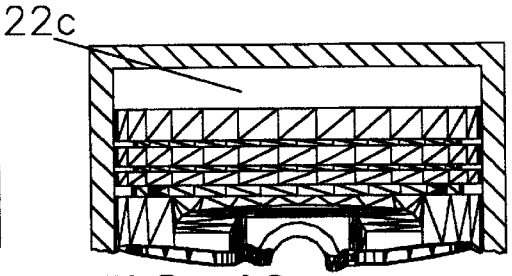
FIGS. 10, 11 and 12 are enlarged views of the combustion chambers of FIGS. 7, 8 and 9.
Figure 11:
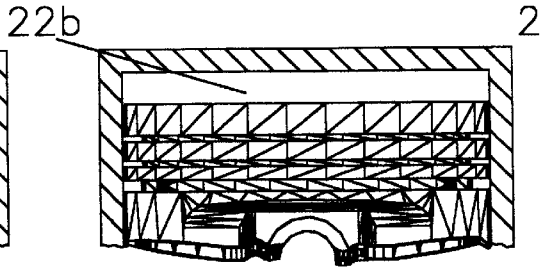
Figure 10:
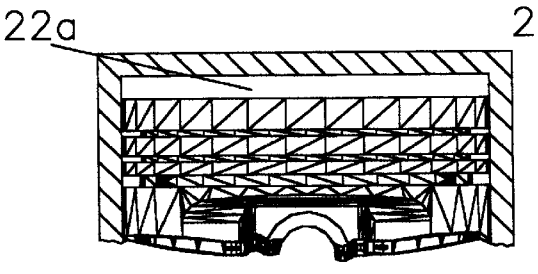
Figure 9:
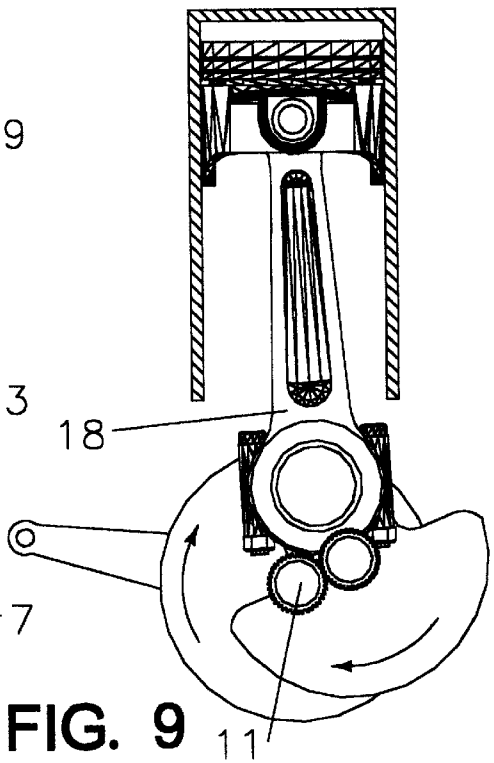
FIGS. 7, 8 and 9 are front elevation views comparing the effect of sun gear rotation on combustion chamber volume.
Figure 8:
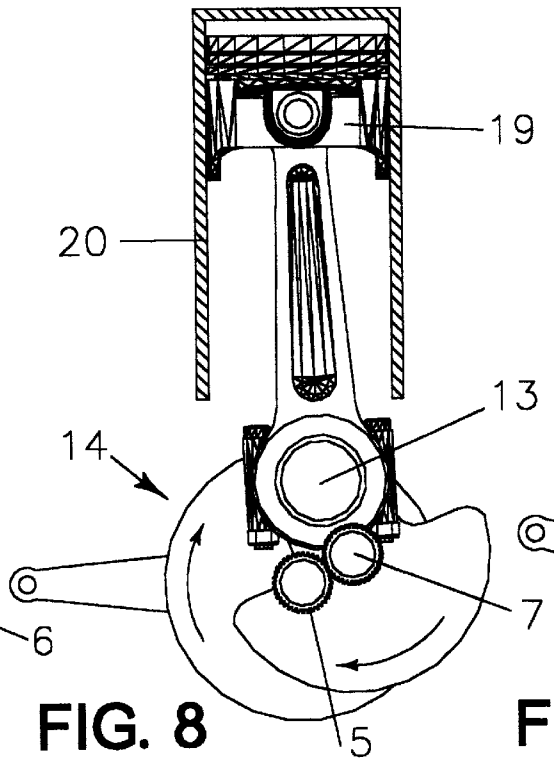
Figure 7:
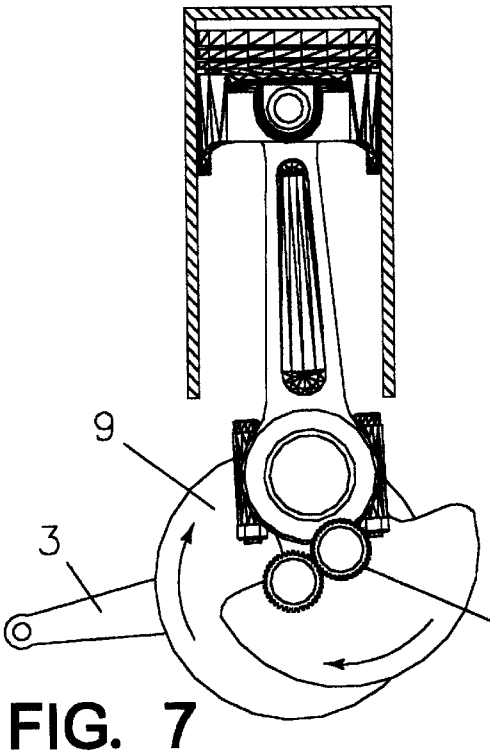

The contemplated most important effect of such a change in gear alignment is that of the piston height at compression TDC. With all other constraining surfaces of the combustion chamber fixed, a change in piston height will result in a proportional change in the compression ratio. Using as a baseline the specifications of the simple embodiment, moving the adjustment lever counterclockwise ten degrees results in a trailing angle reduction from 145° to 135° and a piston height increase at TDC of 0.097 units, decreasing the combustion chamber volume 22 and raising the compression ratio from 9:1 (22*b*) to 12.7:1 (22*c*). This change is illustrated in FIGS. 7,8, 10 and 11, with FIGS. 7 and 8 showing all affected components including the adjustment lever 3. FIGS. 10 and 11 are enlarged views of the combustion chamber. FIGS. 7 and 10 illustrate a trailing angle of 135°. FIGS. 8 and 11 show the baseline 145° as do all other engine illustrations except those shown on sheet 4 for comparison. An additional counterclockwise movement to a trailing angle of 125° increases the piston height at TDC an additional 0.092 units to 0.189 (not illustrated) and the compression ratio to 20.4:1. Equivalent angular changes in adjustment lever position in the clockwise direction result in increased combustion chamber 22*c* volume and compression ratios of 6.9:1 at a trailing angle of 155° as shown in FIGS. 9 and 12 and 5.6:1 at 165° (not illustrated). See the chart in FIG. 16.

It is important to note that these changes can be made in any increments during any mode of engine operation. Continual adjustments during operation can be accomplished using inputs from various sensors, most of which are in use on current vehicles. These include engine RPM, throttle position, mainshaft position (ignition and injector timing), mass airflow, manifold absolute pressure, coolant and inlet air temperature, exhaust oxygen and knock sensors. Some also use exhaust gas temperature measurements. Cardioid cycle engines should add a position sensor from the adjustment device to supplement the mainshaft position input and for control of the adjusting means.

Multiple basic profiles can be established for each mode of engine operation including starting, idling, acceleration, deceleration, part load steady cruise and full load. Each of these may consider optimization for fuel economy, maximum power, emission suppression or other desirable characteristics in engine controller programming.

The one area that appears to offer more room for improvement than others is the part load cruise area. The majority of IC engines in use today operate at part throttle except for brief occasional periods. It is well known that Otto cycle engines operate more efficiently as compression ratios increase. Increasing the compression ratio increases the detonation resistance (or octane rating) requirement in gasoline engines. Factors in the petroleum industry combined with the foregoing facts have resulted in the production of most current engines of this type with a compression ratio in the order of 9:1. The recent appearance of knock sensors and engine controllers which use their input to retard ignition timing supports the opinion that this is near the maximum compression ratio feasible for current engine technology and economically available fuel.

Air/fuel mixtures however, are not sensitive to compression ratios but to compression pressure and temperature. Unthrottled induction allows maximum filling of the cylinder to pressure near atmospheric at the beginning of the compression stroke. These conditions result in pressures and temperatures just prior to and during the ignition event which at times approach detonation levels. As stated above, nearly all operation of this type of engine is throttled. In typical part load modes an induction system may be throttled to a manifold absolute pressure of 40–50% of atmospheric. In this case most of a conventional engine's operation is at pressures that are less than half those of highest efficiency. The disclosed invention will allow engines to operate at improved efficiency by continually adjusting the compression ratio to produce optimum compression pressures.

For obvious reasons the journalshaft gear 6 must be installed concentric with the journalshaft axis of rotation 15 which requires that the pitch diameter of the journalshaft gear 6 and, for a 1:1 ratio also the sun gear 5, be equal to the offset of the disc bore 10 (one-half of the stroke of the mainshaft assembly 8). In the simple embodiment the mainshaft extension 7 must be free to rotate within the inner diameter 25 of the sun gear 5. This requirement limits the diameter of the mainshaft extension to approximately 75% of the pitch diameter when sufficient material for minimum strength of the gear is left below the root diameter. Multi-cylinder engines which deliver their torque to the load at a single point must transmit torque through this portion of the mainshaft assembly. This limitation should not affect conventional design for single cylinder light duty engines or large marine or stationary engines which require sufficiently large displacements with longer strokes. A preferred embodiment for common automotive sized engines utilizes a four gear ring and planet system to maintain the same drive function as the simple embodiment without limiting the torsional strength of the mainshaft assembly; however, a drive means can comprise gears, belts, chains, shafts or the like.

PREFERRED EMBODIMENT

Figures 13, 14, 15:
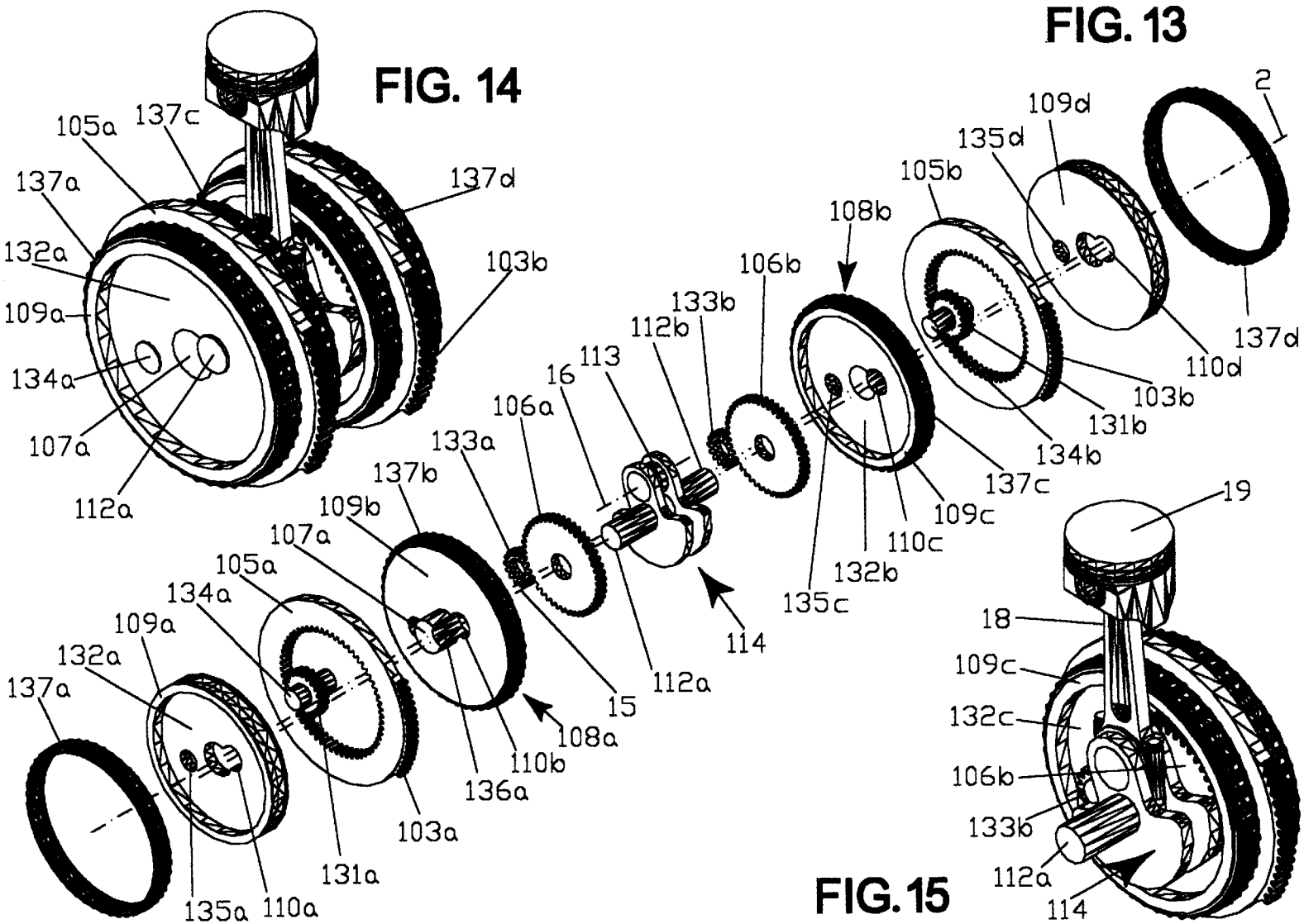
FIG. 13 is an exploded perspective view of a preferred embodiment of the rotating assembly of the invention.
FIG. 14 is a perspective view of the assembled preferred embodiment of FIG. 13.
FIG. 15 shows the same view as FIG. 14 but with the front discs, bearings and gears removed to reveal the journalshaft and internal components.

The previous embodiment described this invention in simple form to facilitate an understanding of the specifications and drawings. That embodiment is adequate for the types of engines referred to in the previous paragraph. For higher torque multi-cylinder engines of intermediate displacement a preferred embodiment offers increased strength and durability. The preferred embodiment provides an additional disc per mainshaft segment, describes the bearings, replaces the sun gear with a ring gear, adds a two gear set to return the journalshaft to a 1:1 ratio in the original direction of rotation and augments the drive means between mainshaft segments. The adjustment levers are replaced with external gear segments on the ring gears, although levers or any other adjustment means can be used. In FIGS. 14 and 15 the connecting rod 18 and piston 19 assemblies are identical with those of the simple embodiment. The journalshaft 114 differs only in length and the bearing and gear mounting of the arbors 112. Each disc 109 contains a recess 132 in the face installed opposite the ring gear 105 to receive the additional gear set 106 and 133 in a compact configuration. The ring gears 105 are larger in diameter than the discs 109 and are rotatably received in an annular groove in the engine crankcase (not shown). An integral gear segment 103 on the outside diameter of each ring gear 105 provides interconnection for a means to adjust the trailing angle, replacing the lever 3 in the simple embodiment. Barrel roller bearings 137 located on the outside diameters of the discs 109 stabilize the mainshaft 108, resist axial and radial movement and provide a more compact assembly since they require no additional length. To allow a more detailed view in FIG. 13 the disc bearings 137*b* and 137*c* are shown assembled on their respective discs 109*b* and 109*c* and the identical outer bearings 137*a* and 137*d* are exploded from their discs 109*a* and 109*d*.

In operation, forces acting on the combustion chamber surface of the piston 19 cause the piston to move axially in the cylinder 20 toward the mainshaft 108. A component of the piston forces is transferred through the pivotally mounted connecting rod 18 and transmitted to the journal 113 of the journalshaft 114 by the opposite end of the connecting rod 18 which is rotatably mounted thereon. As is the case in the simple embodiment previously described, at TDC a torque is created about the mainshaft rotational axis 2 by the resultant force acting on a substantial moment arm.

For comparison this preferred embodiment is described with the same trailing angle and strokes as the simple embodiment. This alignment is maintained with the four gear drive train adjusted for a 145° trailing angle. TDC occurs when the moment arm is approximately 0.4 unit in the direction which affords a positive torque application and the thrust line from the piston 19 to the journal 113 is approximately five degrees from the plane which contains both the cylinder axis and the mainshaft axis of rotation 2. This force applied to the journal 113 is transmitted through the single piece journalshaft 114 to its rotational bearing surfaces, the journalshaft arbors 112, each of which is rotatably received in the bores 110 of a pair of mainshaft discs 109. The offset of these bores 110 establishes the mainshaft stroke. A journalshaft gear 106 is fixed onto each journalshaft arbor 112 and located within the adjacent disc recess 132 when assembled. A planet pinion 133 fixed onto the planetshaft 134 and enmeshed with the journalshaft gear 106 is also located within the disc recess 132. Fixedly attached to the opposite end of the planetshaft 134 and located on the side opposite the recess 132 of the disc 109 surrounding the pinion 133 and the journalshaft gear 106 is the planet gear 131, enmeshed with the ring gear 105. The ring gear is rotatably mounted but constrained by an adjustment means (not shown) acting through a gear segment 103 on the ring gear 105 outside diameter.

The above described force acting on the journalshaft 114 causes the mainshaft segments 108 to rotate since the journalshaft 114 is not free to independently rotate due to the gear train engagement with the constrained ring gear 105. The gear train as illustrated contains the journalshaft gear 106 to pinion 133 engagement in a 3:1 ratio and the planet gear 131 comounted on the planetshaft 134 engaged in a 1:3 ratio with the ring gear 105 for a 1:1 final gear train ratio. The stated ratios (n) are based on the number of teeth on the respective gears, but since the number of revolutions of a planet gear rolling inside a stationary internal tooth ring gear in a hypocycloidal arrangement is (n−1) per circuit, the rotating gears complete only two revolutions relative to the stationary components. Rotation of both the journalshaft 114 and the mainshaft 108 is in the same direction so that the journalshaft 114 completes one revolution relative to the mainshaft 108 which carries it for each revolution of the mainshaft, thereby completing two revolutions relative to the engine housing (not shown) and four strokes of the piston 19 for each 360° of mainshaft 108 rotation.

The second mainshaft disc 109 of each pair is located outboard (away from the rod 18) of the first and is identical with all other mainshaft discs. A mainshaft extension 107 which connects the pair can be formed integral with one of the discs 109 of each pair. When assembled each disc 109 of a pair and the connecting extension 107 between them are fixedly united into a single assembly sandwiching the ring gear 105 and planet gear 131. In this preferred embodiment the connecting extension 107 can be made as large in diameter as desired provided clearance with the planet gear 131 is maintained. If interference with the journalshaft arbors 112 is present due to a small offset of the journalshaft axis of rotation 15, a relief 136 can be formed for clearance. The forces from the journalshaft 114 which produce a rotation of the mainshaft 108 are transmitted through the journalshaft disc bores 110 in which the journalshaft is supported. Each journalshaft arbor 112 extends through a pair of discs 109 and the open area encased by the ring gear 105 so that the journalshaft 114 is supported in four disc bores 110, thereby adding stability to the entire rotating assembly. Each planetshaft 134 is supported in the planetshaft bores 135 of each disc 109 in a pair, further enhancing both the stability and torsional strength of the assembly. Each disc 109 rotates in a barrel roller bearing 137 contained in the engine housing (not shown). For longitudinal compactness in this embodiment a mainshaft disc 109, a main bearing 137 and a gear set 106 and 133 all exist in the length of the disc. The embodiment illustrated in FIG. 14 would have slightly over five inch cylinder spacing with a four inch bore in multi-cylinder configurations.

For a multi-cylinder embodiment of the previous description it is not necessary to repeat all of the components. The adjacent pair of discs along with their main bearings and sandwiched ring gear will carry one end of the next journalshaft and its adjacent journalshaft gear, planetshaft pinion, planetshaft and planet gear by forming two additional bores in each of the existing discs of that pair. One additional bore is required for the second journalshaft mandrel and the other for the added planetshaft. With a 1:3 ratio there is sufficient space for a second planet gear inside the ring gear, and with the end disc recesses unoccupied as shown in FIG. 14, ample room for the journalshaft gear and its pinion is available. FIG. 15 shows the recess 132*c* with the installed gear set. The angular spacing for the added bores is determined by dividing 360° by the total number of cylinders. Since all four strokes are completed in one revolution of the mainshaft a four cylinder engine will locate the mainshaft offsets in two planes similar to those of a current V8 engine. The journalshaft and remaining parts on the other end as shown in FIG. 15 must be added to complete the functional cylinder.

The various calculations used to obtain the data presented in these specifications are basic proven and accepted formulas of physics and thermodynamics. There are essentially no assumptions made. The results confirm that there will be substantial increases in torque output and in efficiency of operation of an engine utilizing the described improvements under the ideal conditions associated with basic formulas. The same method and conditions were applied to both engines to produce the chart presented in FIG. 19. In this chart the theoretical torque output from a single power stroke of a conventional IC (labeled Prior Art) engine is contrasted with that of one embodiment of the cardioid cycle engine. The torque is plotted per square unit of piston surface area exposed to cylinder pressure. In this chart the theoretical pressure is calculated in pounds per square inch, and the offsets of the two shafts as 1.25 inches for the mainshaft and 1.75 inches for the journalshaft (or a ratio of 0.7 as plotted on the chart of FIG. 17), so the results are shown in inch-pounds per square inch of piston surface. The alignment between shafts used in this embodiment is a 145° trailing angle which results in a 2.035 inch intake stroke for the cardioid cycle piston. The conventional engine curve is plotted using the same stroke. The pressure drop is calculated using the classic thermodynamic formula for ideal gases: $P1/P2=(V2/V1)^k$, using 800 psi for the maximum pressure and k to equal a conservative 1.3. Both the torque and pressure are plotted against the scale on the vertical axis.

It is difficult to illustrate an easily understandable relationship between the uniform conventional strokes and cardioid cycle strokes. The conventional power stroke is completed in 180° of a 720° cycle of crankshaft rotation with a constant offset. The power stroke of this embodiment of the cardioid cycle is completed in 103° of a 360° cycle with a constantly varying effective offset. Two scales are shown on the horizontal axis and are labeled to indicate the corresponding engine type. The graphs indicate that the peak torque developed per power stroke by the cardioid cycle is more than twice that of the conventional engine. If the cardioid curve were also plotted on the 200° scale the conventional engine curve would cross near the point where exhaust valves normally open. Since the cardioid power stroke occurs once every revolution of its output shaft and the conventional power stroke occurs every other revolution, at the same speed (rpm) the calculated torque of the cardioid cycle engine is twice that shown by the chart of FIG. 19. Same RPM comparisons of torque output do not, however, provide a complete representation of the power output and efficiency of the two cycles. The embodiment plotted in the chart of FIG. 19 has a power stroke of 5.16 inches when the intake stroke is 2.035 inches. The journalshaft rotates through 720° relative to the cylinder block while the main (or output) shaft rotates 360°. The increment of the torque produced by the journalshaft component of the offset is effectively geared in a 2:1 ratio to the mainshaft. The length of this stroke and the resulting piston speed will limit this embodiment to lower maximum RPM than the conventional to which it is compared.

Previous charts are scaled to show the lengths of the strokes, but do not include a curve of a conventional engine to contrast the magnitude of the increase in expansion of and energy extracted from the combustion of the fuel. Neither does the chart of FIG. 19 since it is plotted against shaft rotation rather than piston displacement or volume. A numerical comparison of the lengths of the intake strokes vs. the expansion strokes will reveal how much further the expansion process is carried by the cardioid cycle. This comparison can be made by determining the stroke lengths from FIG. 16.

Figure 19:
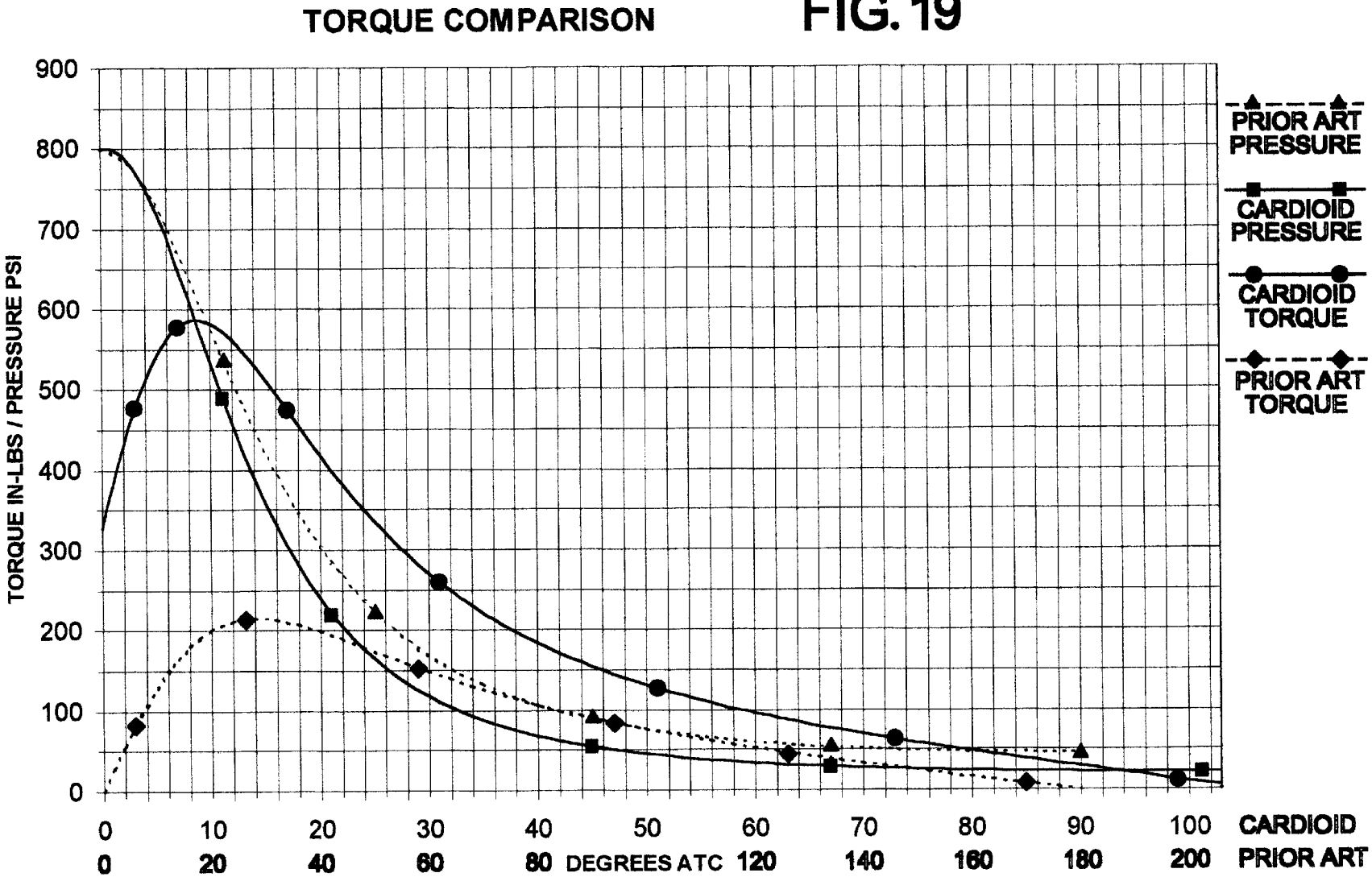
FIG. 19 is a chart contrasting the torque developed during the power stroke of a cardioid cycle cylinder with that of a conventional engine cylinder.

FIG. 19 does illustrate that the pressure drops more rapidly in the cardioid cycle cylinder than in a conventional cylinder. This drop and its causal increase in volume reduce the cylinder temperature, thus reducing the time and rate of heat loss through the adjacent surfaces. Some previous inventions have proposed slowing the piston travel in this area to allow time for more complete combustion and higher cylinder pressure, approaching constant volume addition of heat. This still had to be accomplished with pressures low enough to prevent detonation of the unburned end gases. Using an adjustable compression ratio embodiment of the cardioid cycle design will allow higher pressures at and near top center while retaining the advantages referred to above.

Figure 18:
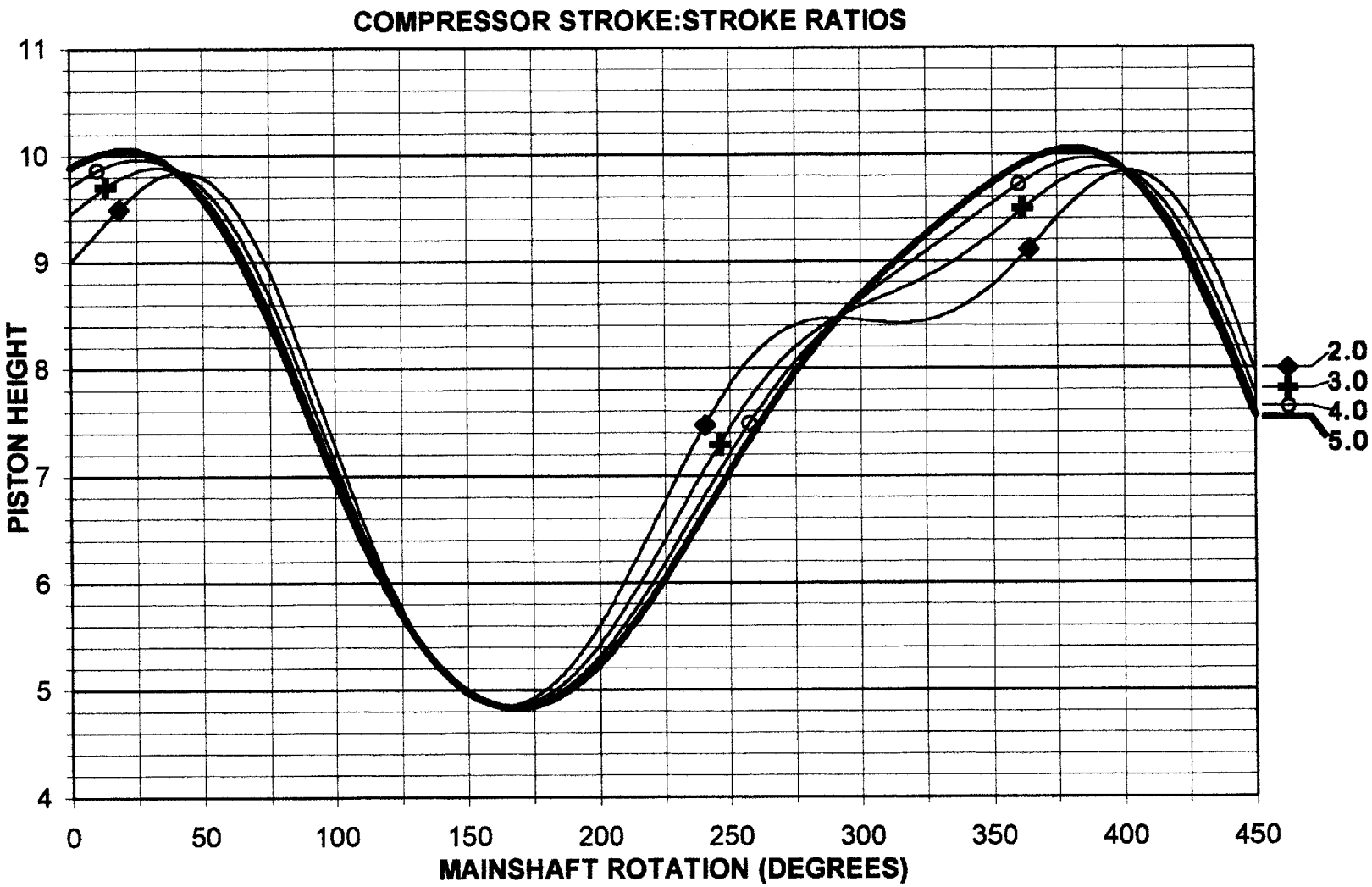
FIG. 18 is a continuation of FIG. 17 into the range of ratios where only two strokes are produced for each 360° of mainshaft rotation. These are discussed for use with compressors or pumps.

Though embodiments of the previously described type of construction can be used for compressors and pumps, mainshaft stroke to journalshaft stroke ratios higher than that at which the intake stroke disappears from the 360° cycle may offer additional or different advantages. The chart on FIG. 18 is a continuation of that on FIG. 17 and includes the curve generated by a 2.0 ratio from FIG. 17 which is the approximate point where the intake stroke of a four stroke cycle engine disappears. Curves are shown for and labeled as 2.0 through 5.0 ratios, and the alignment continues as 135° trailing angle. As may be seen from the plot of the 5.0 ratio curve, the downstroke, which for a compressor now becomes the intake stroke, indicates a rapid drop of the piston and a much slower rise. In this embodiment the drop or intake stroke is completed in 147° of mainshaft rotation, while the upstroke or compression stroke requires 213°. This provides an increased mechanical advantage which reduces the average torque required during the compression stroke by 18% over that required by a conventional 180° compression stroke. The 4.0 ratio curve shows an intake stroke of 141° and a compression stroke of 219° with a reduction in average required torque of 22%. While the slope of the portion of these curves representing the compression stroke is lower than that of the conventional compressor, it decreases even more near the top of the stroke where the pressure increases, allowing even greater reduction in input torque.

The restrictions on the diameter of the input shaft discussed earlier should not affect the use of the simple two gear embodiment in a compressor or pump, since the choice of an optimum stroke ratio for these machines will require a sun gear diameter of five or six times that of a similar sized engine. If desired, the variable piston height control feature may also be included in compressor design.

I claim:

1. A machine comprising at least one piston reciprocating in a cylinder, a machine housing locating axially aligned bearing bores for carrying an input/output shaft, a connecting rod attached to said piston at a first end and to the journal of a second crankshaft at a second end, an input/output shaft assembly rotatably carried in the bearings of said bores, the segments of said input/output shaft being connected to each other by and drive forces transmitted through said second crankshaft rotatably journaled in the webs of said input/output shaft about a second axis parallel to and offset from the axis of rotation of said input/output shaft, said journal being offset from said axis of rotation of said second crankshaft and located by arms thereof defining a third parallel axis about which said second end of the connecting rod oscillates as said journal rotates within said second end of the connecting rod, at least one drive wheel fixedly attached to at least one end of said second crankshaft and controlled by a drive means so that said second crankshaft is constrained to rotate about said second axis as said second axis orbits around said axis of rotation of the input/output shaft, the rotation of said second crankshaft being in the same direction and at the same angular velocity relative to said input/output shaft as said input/output shaft maintains and said piston both stops and starts in motion again four times, creating four strokes of the piston in one revolution of the input/output shaft.

2. An apparatus as described in claim 1 wherein the piston both stops and starts in motion again more than two times in one revolution of the input/output shaft.

3. An apparatus as described in claim 1, which when operated as an internal combustion engine, is capable of being configured by said drive means to cause the top dead center position of the piston on its compression stroke to occur when the thrust line from the connecting rod attachment at said piston to the point of application of force to the input/output shaft is offset from the axis of rotation of said input/output shaft so as to produce a substantial moment arm.

4. An apparatus as described in claim 1 which, when operated as an internal combustion engine, is capable of being configured by said drive means and ratio of the offset of the input/output shaft crank to the offset of the second crankshaft crank, to cause the expansion stroke to be substantially longer than the intake or compression stroke.

5. An apparatus as described in claim 1, when operated as an internal combustion engine, which will produce both a moment about the output shaft axis which is greater throughout the expansion stroke than that of a conventional engine of equivalent intake stroke and an expansion stroke which is longer than that of said conventional engine.

6. An apparatus as described in claim 1, when operated as an internal combustion engine, in which the angular relationship between the input/output shaft and the second crankshaft is capable of being altered to vary the compression ratio.

7. An apparatus as described in claim 1, when operated as an internal combustion engine, in which high compression ratios are capable of being employed without impediment of flow or interference between the piston and valves.

8. An apparatus as described in claim 1, when operated to urge a fluid, which causes the piston to move more slowly on the stroke decreasing cylinder volume than the stroke increasing said cylinder volume.

9. An apparatus as described in claim 1 which, when operated as a compressor, enables two stage operation with a single cylinder and a single acting piston.

10. A machine comprising at least one piston reciprocating in a cylinder, said piston having four strokes of variable lengths, wherein the length of the expansion stroke is greater than the length of the other strokes and said piston both stops and starts in motion again four times, creating four strokes of the piston in one revolution of the input/output shaft.

11. An apparatus as described in claim 10, which is capable of being configured by a drive means to cause the top dead center position of the piston on its compression stroke to occur when the thrust line from the connecting rod attachment at said piston to the point of application of force to the input/output shaft is offset from the axis of said input/output shaft so as to produce a substantial moment arm.

12. An apparatus as described in claim 10, which is capable of being configured by said drive means and ratio of the offset of the input/output shaft crank to the offset of the second crankshaft crank to cause the expansion stroke to be substantially longer than the intake or compression stroke.

13. An apparatus as described in claim 10, which will produce both a moment about the input/output shaft axis which is greater throughout the expansion stroke than that of a conventional engine of equivalent intake stroke and an expansion stroke which is longer than that of said conventional engine.

14. An apparatus as described in claim 10 wherein the angular relationship between the input/output shaft and the second crankshaft is capable of being altered to vary the compression ratio.

15. An apparatus as described in claim 10 wherein high compression ratios are capable of being employed without impediment of flow or interference between the piston and valves.

* * * * *